US008088048B2

(12) United States Patent
Tsai

(10) Patent No.: US 8,088,048 B2
(45) Date of Patent: Jan. 3, 2012

(54) SWIVEL EXERCISER

(75) Inventor: Jao-Hsing Tsai, Hsinchu (TW)

(73) Assignee: Cheng-Kang Chu, Hsinchu (TW)

( * ) Notice: Subject to any disclaimer, the term of this patent is extended or adjusted under 35 U.S.C. 154(b) by 65 days.

(21) Appl. No.: 12/688,941

(22) Filed: Jan. 18, 2010

(65) Prior Publication Data

US 2011/0077137 A1 Mar. 31, 2011

(30) Foreign Application Priority Data

Sep. 25, 2009 (TW) ..... 098217736

(51) Int. Cl.
*A63B 21/00* (2006.01)

(52) U.S. Cl. ..... 482/96; 482/51; 482/132

(58) Field of Classification Search ..... 482/146, 482/147, 95, 96, 72
See application file for complete search history.

(56) References Cited

U.S. PATENT DOCUMENTS

| | | | | |
|---|---|---|---|---|
| 4,832,332 | A * | 5/1989 | Dumbser | 482/8 |
| 4,989,860 | A * | 2/1991 | Iams et al. | 482/132 |
| 5,820,524 | A * | 10/1998 | Chen | 482/51 |
| 2005/0049116 | A1* | 3/2005 | Huang | 482/51 |
| 2010/0062914 | A1* | 3/2010 | Splane | 482/96 |

* cited by examiner

*Primary Examiner* — Jerome W Donnelly

(57) ABSTRACT

A swivel exerciser includes a base frame, left and right handlebars, a plate on the base frame, a curved rail around the plate and fixedly secured onto the base frame, left and right stop members at both ends of the rail, pivotal left and right arms, left and right pedals on ends of the left and right arms respectively and being slidable on the rail, left and right projecting plates each at one side of the left or right arm and having a through hole, and an inverted U-shaped member. In a first exercise mode, the inverted U-shaped member has both ends inserted into the through holes of the pedals for interconnection so that both the left and right pedals may swing clockwise or counterclockwise. In a second exercise mode and after removing the inverted U-shaped member, either pedal may swing clockwise or counterclockwise independently.

4 Claims, 5 Drawing Sheets

SWIVEL EXERCISER

BACKGROUND OF THE INVENTION

1. Field of Invention

The invention relates to exercise equipment and, more particularly, to a swivel exerciser for exercising the waist and the legs.

2. Description of Related Art

An endless array of exercise equipment has been commercially available. A type of exercise equipment is a swivel exerciser. For example, a conventional swivel exerciser is shown in FIG. 5 and comprises a base frame 1, a front swivel assembly 2 having two handlebars 4, and a rear swivel assembly 3 having two pedals 5. In use, a person may have feet stepping on the pedals 5 and hands grasping the handlebars 4. Next, the person may turn the front and rear swivel assemblies 2, 3 to exercise the arms and the legs.

However, the well known swivel exerciser suffers from several disadvantages. For example, the pedals 5 with the whole weight of a person being loaded thereon are only supported by two arms. Hence, it is not safe. Further, the arms may shake vertically when the pedals 5 are turning. In turn, the swivel exerciser may vibrate the person's body strongly. The person, thus, may feel uncomfortable. Moreover, it is monotonous. Thus, the need for improvement still exists.

SUMMARY OF THE INVENTION

It is therefore one object of the invention to provide a swivel exerciser comprising a base frame comprising a front foot bar, a rear foot bar together with the front foot bar elevating the base frame, a support extending out of the front foot bar, a left handlebar releasably secured to the support, and a right handlebar releasably secured to the support. A plate is mounted on the base frame, and a curved rail is mounted around the plate and fixedly secured onto a top of the base frame. A projecting left stop member is at one end of the rail, and a projecting right stop member is at the other end of the rail. A retaining member is mounted on a center of the plate. A left bossed hole is in the retaining member, and a right bossed hole is in the retaining member. A left arm has one end pivotably secured to the left bossed hole, and a right arm has one end pivotably secured to the right bossed hole. A left pedal is mounted on the other end of the left arm, and a right pedal is mounted on the other end of the right arm. An elongated left slide is mounted below the left pedal to be slidable on the rail, and an elongated right slide is mounted below the right pedal to be slidable on the rail. A left projecting plate at one side of the left arm has a through hole, and a right projecting plate at one side of the right arm has a through hole. The base frame further includes an inverted U-shaped member. In a first exercise mode, the inverted U-shaped member has both ends inserted into the through hole of the left pedal and the through hole of the right pedal respectively to interconnect the left and right pedals so as to swing both the left and right pedals clockwise or counterclockwise. In a second exercise mode and in response to removing the inverted U-shaped member, the left pedal is adapted to swing clockwise or counterclockwise independently, and the right pedal is adapted to swing clockwise or counterclockwise independently.

By utilizing the invention, the following advantages can be obtained. Weight of a person stepping on the pedals is shared by the rail due to the provision of the slides. Hence, the arms and associated components are more durable. Further, its operation is smoother without vibration. Furthermore, both the legs and the waist can be effectively exercised Moreover, it can save cost and, thus, the manufacturing cost.

The above and other objects, features and advantages of the invention will become apparent from the following detailed description taken with the accompanying drawings.

DETAILED DESCRIPTION OF THE INVENTION

Figure 1:
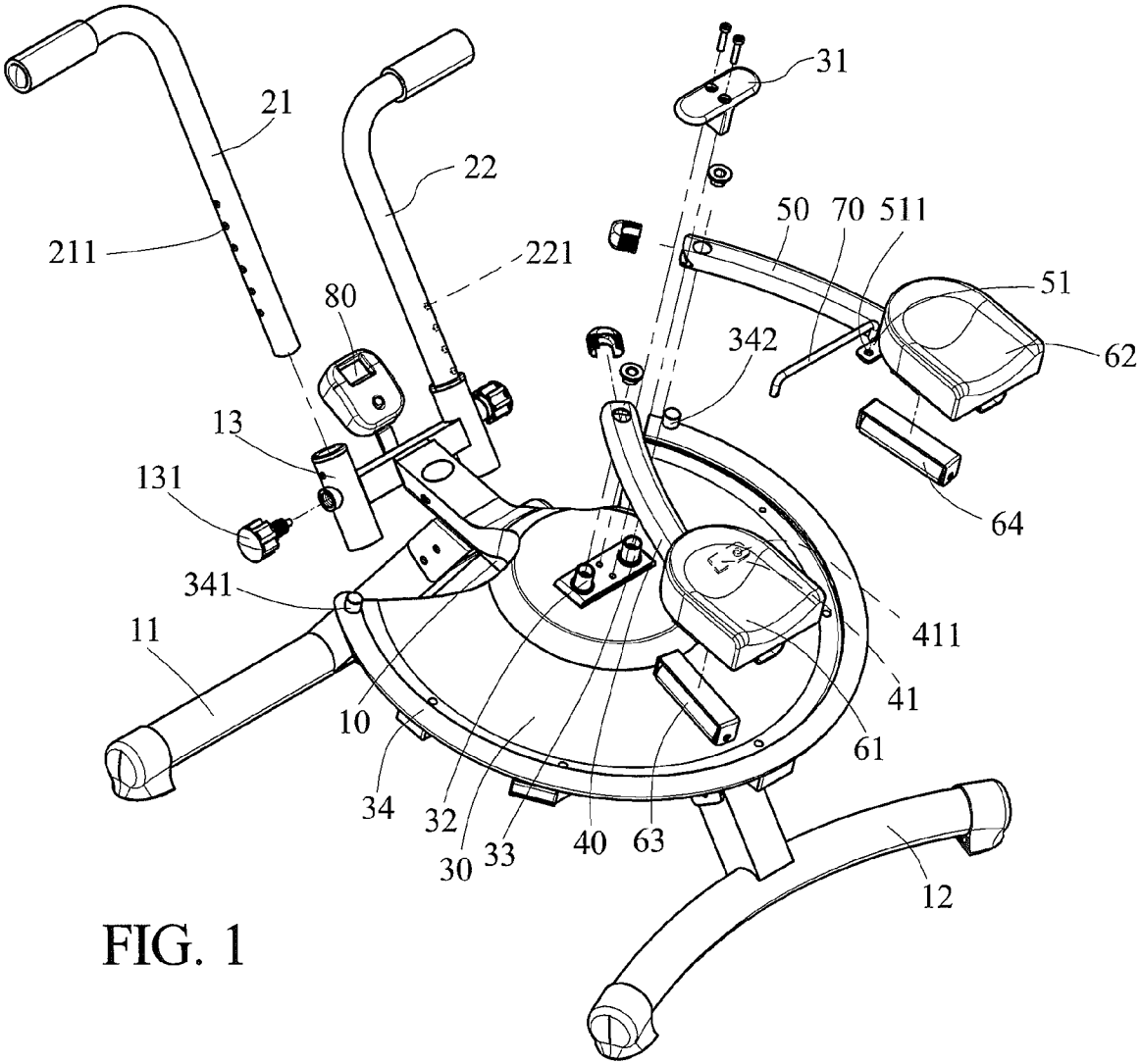
FIG. 1 is an exploded view of a preferred embodiment of a swivel exerciser according to the invention.
Figure 2:
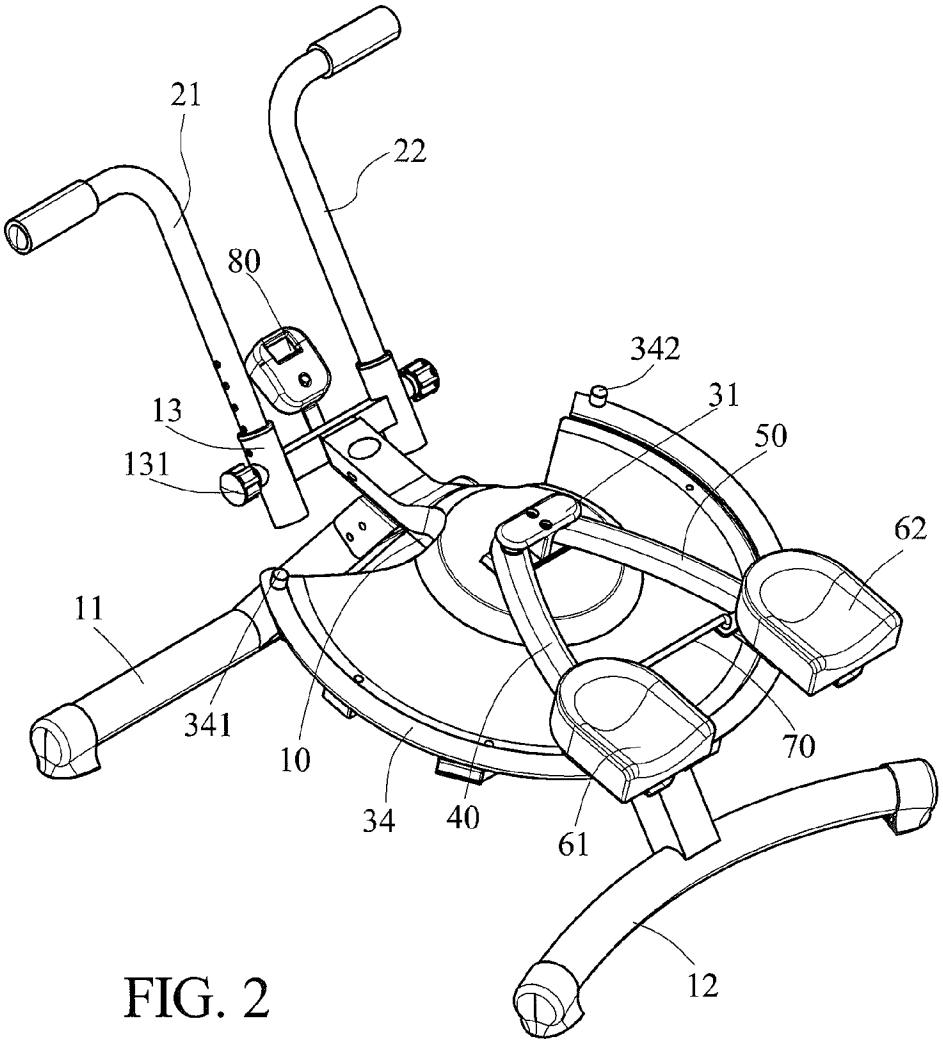
FIG. 2 is a perspective view of the assembled swivel exerciser.

Referring to FIGS. 1 to 4, a swivel exerciser in accordance with a preferred embodiment of the invention comprises the following components as discussed in detail below.

A base frame 10 comprises a front foot bar 11, a rear foot bar 12 together with the front foot bar 11 for supporting the base frame 10 a predetermined height above the supporting ground, a horizontally I-shaped support 13 obliquely projecting forward, a left handlebar 21, and a right handlebar 22. Each of the left and right handlebars 21, 22 has a series of apertures 211 or 221 along a portion of its length. The support 13 has two threaded fasteners 131 each driven through one side into one of the apertures 211 or 221 for adjusting height of either one of the left and right handlebars 21, 22 and securing the support 13 and either one of the left and right handlebars 21, 22. Preferably, heights of both the left and right handlebars 21, 22 are the same after adjustment.

A disc-like plate 30 is mounted on the base frame 10. The plate 30 comprises a T member 31, a left bossed hole 32 on a raised rectangle on a center of the plate 30, and a right bossed hole 33 on the raised rectangle of the plate 30. A curved rail 34 is mounted around the plate 30 and is fixedly secured onto the top of the base frame 10. A projecting left stop member 341 is threadedly fastened at one end of the rail 34, and a projecting right stop member 342 is threadedly fastened at the other end thereof.

A left arm 40 has one end pivotably secured to the left bossed hole 32, and a right arm 50 has one end pivotably secured to the right bossed hole 33. The T member 31 is threadedly secured onto the raised rectangle of the plate 30, with one end of the arms 40, 50 disposed therebelow.

A left pedal 61 is mounted on the other end of the left 40. An elongated left slide 63 is mounted on the underside of the left pedal 61 and is slidably mounted on the rail 34. A left projecting plate 41 is formed at a joining portion of the left arm 40 and the left pedal 61. The left projecting plate 41 has a through hole 411 in proximity to an open end.

Likewise, a right pedal 62 is mounted on the other end of the right arm 50. An elongated right slide 64 is mounted on the underside of the right pedal 62 and is slidably mounted on the rail 34. A right projecting plate 51 is formed at a joining portion of the right arm 50 and the right pedal 62. The right projecting plate 51 has a through hole 511 in proximity to an open end.

An inverted U-shaped member 70 has both ends inserted into the through holes The rail 34 can increase strength of the plate 30 by fixedly fastening onto the top of the base frame 10. The rail 34 is made of steel tube and is structurally strong in nature. Thus, portions of the plate 30 may be saved, because they are covered by the rail 34. This has the advantage of saving the manufacturing material and, thus, the manufacturing cost of the plate 30.

An electric counter 80 is mounted on a central portion of the horizontally I-shaped support 13.

Prior to use, heights of both the left and right handlebars 21, 22 are adjusted as desired by manipulating threaded fasteners 131. Next, both ends of the inverted U-shaped member 70 are inserted into the through holes 411, 511 to interconnect the left and right pedals 61, 62.

Figure 3:
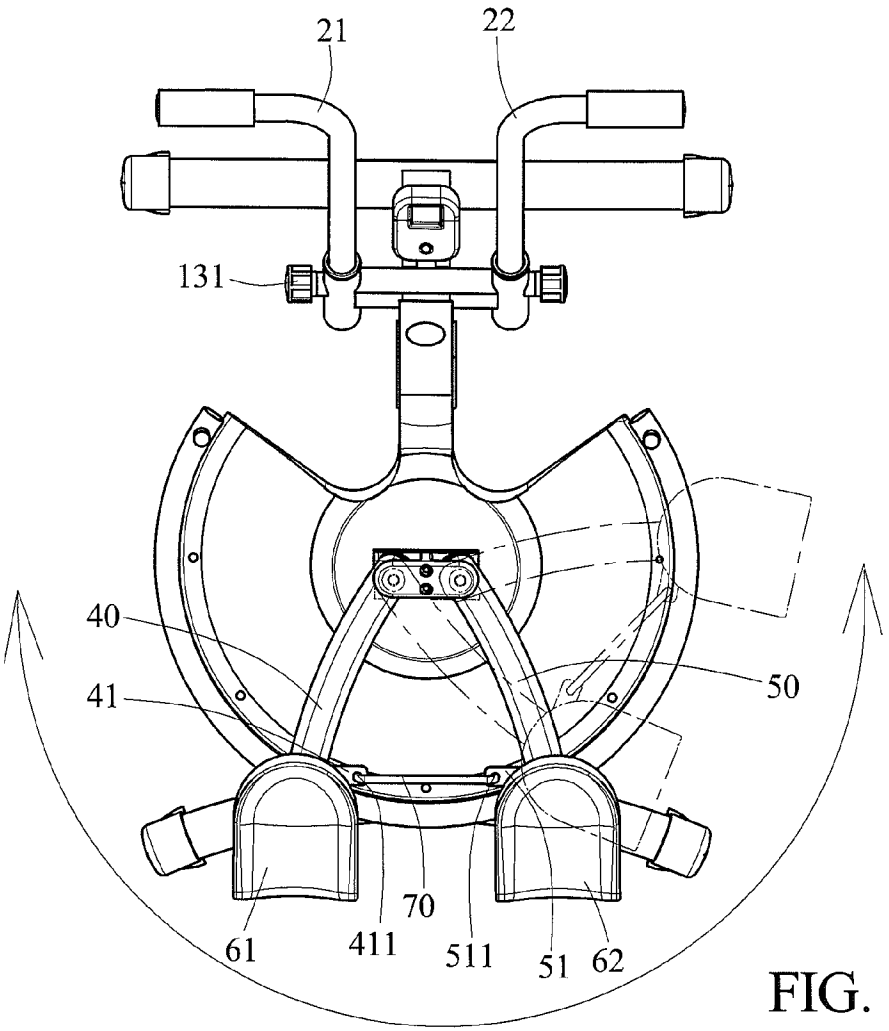
FIG. 3 is a top plan view showing the pedals as a whole rotating clockwise or counterclockwise horizontally in one mode of exercise.

In one exercise mode, a person may have feet stepping on the left and right pedals 61, 62 and hands grasping the left and right handlebars 21, 22 prior to rotating clockwise or counterclockwise horizontally with the left and right pedals 61, 62 swinging as a whole as indicated by the two-head arrow in FIG. 3. This mode can exercise the waist.

In one exercise mode, the right pedal 62 is limited to swing no more than the right stop member 342, and the left pedal 61 is limited to swing no more than the left stop member 341, respectively.

Figure 4:
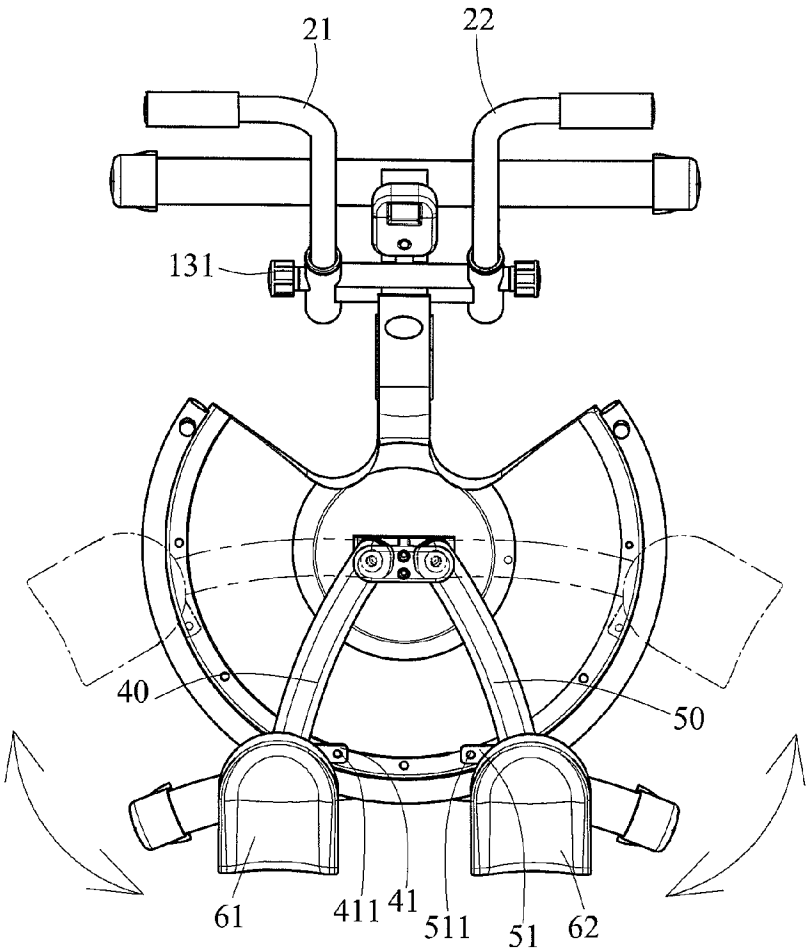
FIG. 4 is a view similar to FIG. 3 showing the left pedal rotating clockwise or counterclockwise horizontally or the right pedal rotating clockwise or counterclockwise horizontally after removing the inverted U-shaped member in the other mode of exercise.
Figure 5:
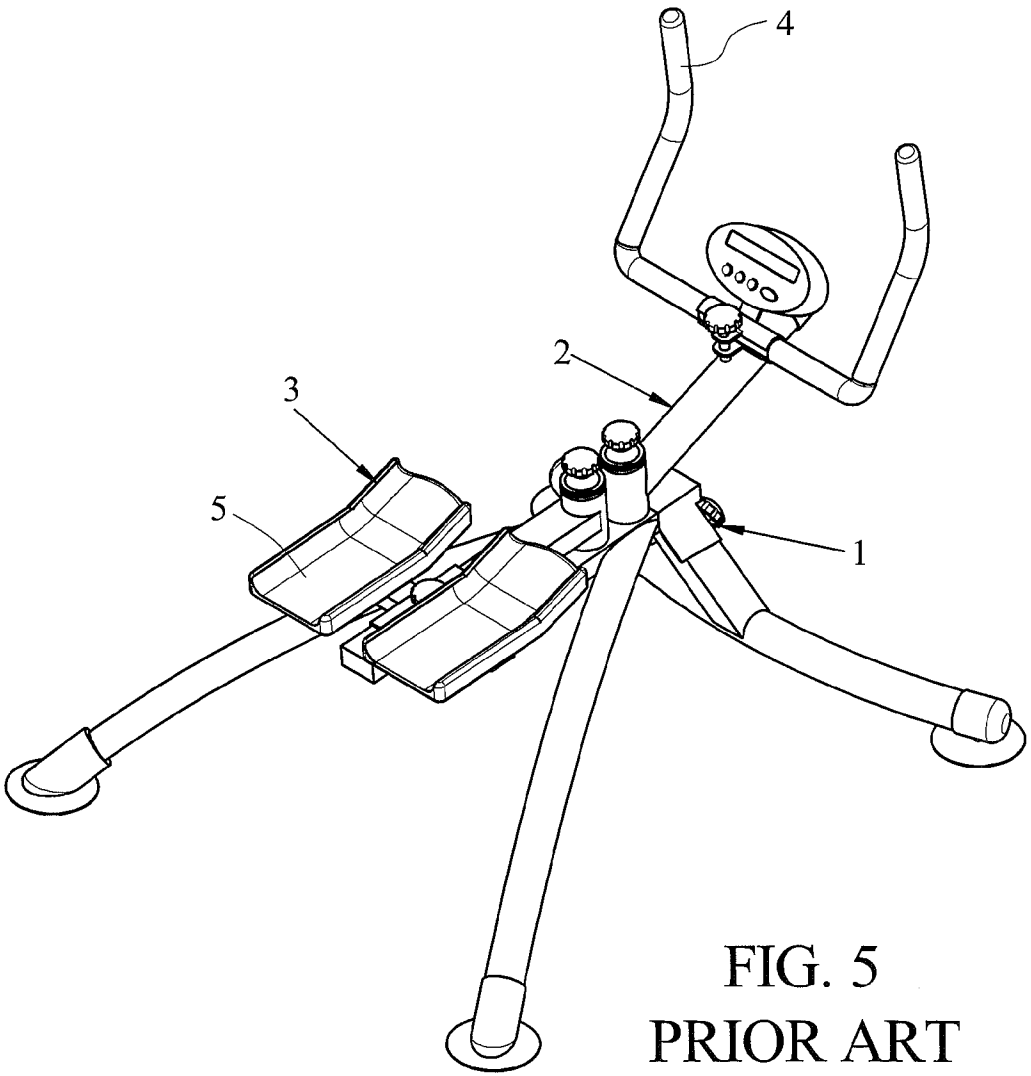
FIG. 5 PRIOR ART
FIG. 5 is a perspective view of a conventional swivel exerciser.

In the other exercise mode as shown in FIG. 4, a person may remove the inverted U-shaped member 70. That is, the left and right pedals 61, 62 may operate independently. Next, the person may have feet stepping on the left and right pedals 61, 62 and hands grasping the left and right handlebars 21, 22. Then, the person may (i) rotate the left pedal 61 clockwise or counterclockwise horizontally and/or (ii) rotate the right pedal 62 clockwise or counterclockwise horizontally as indicated by the left two-head arrow and the right two-head arrow, respectively. This mode can exercise the legs.

In the other exercise mode, the right pedal 62 is limited to swing between a point when the right pedal 62 is retained by the inverted U-shaped member 70 and a point at the right stop member 342. The left pedal 61 is limited to swing between a point when the left pedal 61 is retained by the inverted U-shaped member 70 and a point at the left stop member 341.

While the invention herein disclosed has been described by means of specific embodiments, numerous modifications and variations could be made thereto by those skilled in the art without departing from the scope and spirit of the invention set forth in the claims.

What is claimed is:

1. A swivel exerciser comprising:

a base frame;

a front foot bar of a T-shape having a foot and a leg extending from the foot and terminating in an upper end;

a rear foot bar of a T-shape having a foot and a leg extending from the foot and terminating in an upper end, with the base frame connected to and between the upper ends of the front foot bar and the rear foot bar and elevating the base frame above the feet of the front and rear foot bars;

an I-shaped support including a central portion extending between first and second sides, with the base frame connected to the central portion intermediate the first and second sides, with the front foot bar located intermediate the support and the rear foot bar;

a left handlebar releasably secured to the first side of the support;

a right handlebar releasably secured to the second side of the support;

a plate mounted on the base frame;

a curved rail mounted around the plate and fixedly secured onto a top of the base frame, with the curved rail having a left end and a right end spaced from the left end, with the base frame located intermediate and spaced from the left and right ends, with the plate having a first removed portion extending from the left end to the base frame and a second removed portion extending from the right end to the base frame;

a projecting left stop member at the left end of the rail;

a projecting right stop member at the right end of the rail;

a retaining member mounted on a center of the plate;

a left bossed hole in the retaining member;

a right bossed hole in the retaining member;

a left arm having one end pivotably secured to the left bossed hole;

a right arm having one end pivotably secured to the right bossed hole;

a left pedal mounted on the other end of the left arm;

a right pedal mounted on the other end of the right arm;

an elongated left slide mounted below the left pedal to be slidable on the rail;

an elongated right slide mounted below the right pedal to be slidable on the rail;

a left projecting plate at one side of the left arm and having a through hole;

a right projecting plate at one side of the right arm and having a through hole; and an inverted U-shaped member, wherein in a first exercise mode, the inverted U-shaped member has both ends inserted into the through hole of the left pedal and the through hole of the right pedal respectively to interconnect the left and right pedals so as to swing both the left and right pedals clockwise or counterclockwise; and wherein in a second exercise mode and in response to removing the inverted U-shaped member, the left pedal is adapted to swing clockwise or counterclockwise independently and the right pedal is adapted to swing clockwise or counterclockwise independently.

2. The swivel exerciser of claim 1, wherein each of the left and right handlebars has a plurality of lengthwise apertures so that a fastening position of each of the left and right handlebars and the support is adjustable by securely inserting a fastener through the support into one of the plurality of lengthwise apertures.

3. The swivel exerciser of claim 2, further comprising an electric counter mounted on the central portion of the I-shaped support.

4. The swivel exerciser of claim 1, wherein in the first exercise mode, the right pedal is limited to swing no more than the right stop member and the left pedal is limited to swing no more than the left stop member respectively; and wherein in the second exercise mode, the right pedal is limited to swing between a point when the right pedal is retained by the inverted U-shaped member and a point at the right stop member, and the left pedal is limited to swing between a point when the left pedal is retained by the inverted U-shaped member and a point at the left stop member respectively.

* * * * *